US010961082B2

(12) United States Patent
Sudi et al.

(10) Patent No.: US 10,961,082 B2
(45) Date of Patent: Mar. 30, 2021

(54) ELEVATOR INSPECTION USING AUTOMATED SEQUENCING OF CAMERA PRESETS

(71) Applicant: OTIS ELEVATOR COMPANY, Farmington, CT (US)

(72) Inventors: Sandeep Sudi, Farmington, CT (US); Frank Higgins, Burlington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 558 days.

(21) Appl. No.: 15/859,954

(22) Filed: Jan. 2, 2018

(65) Prior Publication Data

US 2019/0202659 A1 Jul. 4, 2019

(51) Int. Cl.

| | |
|---|---|
| ***B66B 5/00*** | (2006.01) |
| ***B66B 3/00*** | (2006.01) |
| ***B66B 21/02*** | (2006.01) |
| ***B66B 27/00*** | (2006.01) |
| *B66B 9/00* | (2006.01) |

(52) U.S. Cl.

CPC ..... *B66B 5/0018* (2013.01); *B66B 3/00* (2013.01); *B66B 5/0006* (2013.01); *B66B 5/0087* (2013.01); *B66B 21/02* (2013.01); *B66B 27/00* (2013.01); *B66B 9/00* (2013.01)

(58) Field of Classification Search

CPC ... B66B 5/0018; B66B 5/0086; B66B 5/0087; B66B 3/00; B66B 21/02; B66B 27/00; B66B 9/00

USPC ..... 187/390

See application file for complete search history.

(56) References Cited

U.S. PATENT DOCUMENTS 4,203,360 A * 5/1980 Madwed ..... B41N 1/24 101/128.21
4,373,573 A * 2/1983 Madwed ..... F24F 5/0046 165/236
4,645,411 A * 2/1987 Madwed ..... B25J 15/02 198/468.2
5,547,038 A * 8/1996 Madwed ..... B60K 7/0007 180/253
6,109,379 A * 8/2000 Madwed ..... A61G 5/1051 180/252

(Continued)

FOREIGN PATENT DOCUMENTS

CN 101537953 A 9/2009
CN 201494977 U 7/2010

(Continued)

OTHER PUBLICATIONS

Chinese Office Action for Application No. 201910001932.0; dated Apr. 3, 2020; 10 Pages.

(Continued)

*Primary Examiner* — David S Warren
(74) *Attorney, Agent, or Firm* — Cantor Colburn LLP

(57) ABSTRACT

An elevator system is provided. Aspects includes at least one elevator car and a camera affixed to the at least one elevator car, wherein the camera is operated by a controller. The controller is configured to automatically capture, from the camera, media associated with a set of locations, wherein the set of locations are associated with the at least one elevator car. A transceiver transmits one or more sequences of the media captured from the camera.

18 Claims, 5 Drawing Sheets

(56) References Cited

U.S. PATENT DOCUMENTS 6,478,099 B1* 11/2002 Madwed ..... A61G 5/045 180/21
6,863,161 B2 3/2005 Mearns et al.
7,002,462 B2 2/2006 Welch
7,448,473 B2 11/2008 Lindberg et al.
7,832,638 B2 11/2010 Wetzel et al.
8,418,815 B2 4/2013 Encinas et al.
8,540,057 B2 9/2013 Schuster et al.
8,660,565 B2 2/2014 Hall
8,896,216 B2 11/2014 Lee
9,580,276 B2 2/2017 Toutaoui
9,665,932 B2 5/2017 Lauffer et al.
9,667,929 B2 5/2017 Yang
9,734,003 B2 8/2017 Sekine et al.
9,734,693 B2 8/2017 McKinley et al.
9,743,490 B1 8/2017 Li et al.
10,176,385 B2 1/2019 Brunn et al.
10,504,400 B2 12/2019 Wang et al.
2003/0111298 A1* 6/2003 Logan ..... B66B 7/1238 187/391
2004/0094366 A1 5/2004 Weinberger et al.
2004/0206583 A1* 10/2004 Mearns ..... B66B 5/0006 187/391
2006/0232789 A1* 10/2006 Oh ..... G01D 5/305 356/614
2007/0107992 A1 5/2007 Fujita
2007/0170037 A1* 7/2007 Kuroda ..... B66B 29/00 198/322
2008/0024409 A1 1/2008 Tomizawa et al.
2008/0117020 A1 5/2008 Martin
2008/0198117 A1 6/2008 Kumakura
2008/0283342 A1 11/2008 Deplazes et al.
2008/0317382 A1 12/2008 Franz et al.
2009/0040196 A1 2/2009 Duckstein et al.
2009/0057068 A1* 3/2009 Lin ..... B66B 1/468 187/392
2009/0108987 A1* 4/2009 Shikai ..... B66B 13/26 340/3.1
2009/0232383 A1* 9/2009 Verreet ..... G01N 21/952 382/141
2011/0067958 A1 3/2011 Schuster et al.
2011/0240414 A1* 10/2011 Carreno ..... B66B 5/0025 187/390
2012/0018256 A1* 1/2012 Mangini ..... B66B 5/0043 187/247
2012/0294506 A1* 11/2012 Verreet ..... G01N 21/8803 382/141
2013/0119256 A1* 5/2013 Husmann ..... D07B 1/145 250/341.8
2013/0126737 A1* 5/2013 Husmann ..... G01J 5/10 250/341.8
2013/0140134 A1* 6/2013 Senger ..... B66B 29/005 198/322
2015/0154324 A1* 6/2015 Reilio ..... B66B 19/007 703/1
2015/0158699 A1* 6/2015 Haapaniemi ..... B66B 5/0087 702/155
2016/0107861 A1 4/2016 Thebeau et al.
2016/0269701 A1 9/2016 Guo
2017/0015521 A1 1/2017 Toutaoui
2017/0197807 A1 7/2017 Noda et al.
2017/0355554 A1 12/2017 Eleid et al.
2017/0362054 A1* 12/2017 Legeret ..... B66B 5/025
2018/0016117 A1* 1/2018 Palazzola ..... B66B 7/1238
2018/0150806 A1* 5/2018 Eleid ..... G06Q 10/20
2018/0158434 A1 6/2018 Bian et al.
2018/0238815 A1* 8/2018 Mupende ..... G01N 21/952
2018/0273346 A1 9/2018 Hwang et al.
2018/0346286 A1* 12/2018 Fauconnet ..... G06T 7/001
2019/0023529 A1* 1/2019 Lau ..... B66B 5/14
2019/0062105 A1* 2/2019 Saarela ..... B66B 1/40
2019/0112152 A1* 4/2019 Kujala ..... G01N 21/8851
2019/0177122 A1* 6/2019 Mahoney ..... B66B 3/002
2019/0202659 A1* 7/2019 Sudi ..... B66B 21/02
2019/0202660 A1* 7/2019 Mahoney ..... B66B 5/005
2019/0237008 A1 8/2019 Ho et al.
2019/0322489 A1* 10/2019 Watabe ..... B66B 5/02
2020/0011674 A1 1/2020 Fanselow et al.
2020/0102188 A1 4/2020 Holey et al.
2020/0118259 A1 4/2020 Mahadevappa et al.
2020/0126497 A1 4/2020 Wang

FOREIGN PATENT DOCUMENTS

CN 202124380 U 1/2012
CN 102616617 A 8/2012
CN 103482442 B 1/2014
CN 103738804 A 4/2014
CN 203673303 U 6/2014
CN 203682801 U 7/2014
CN 102616613 B 2/2015
CN 104444674 B 3/2015
CN 105731209 A 8/2016
CN 205527123 U 8/2016
CN 106219367 A 1/2017
CN 106494959 A 3/2017
CN 106672721 A 5/2017
CN 105129559 B 6/2017
CN 206336868 U 7/2017
CN 107531452 A 1/2018
EP 1178001 A1 2/2002
EP 3124418 A1 8/2017
JP H08169679 A 7/1996
JP H1149445 A 2/1999
JP 2003192248 A 7/2003
JP 2007276941 A 10/2007
JP 2009214998 A 9/2009
WO 2003066497 A1 8/2003
WO 2006048497 A1 5/2006
WO 2006077654 A1 7/2006
WO 2009051587 A1 4/2009
WO 2010092619 A1 8/2010
WO 2016120373 A1 8/2016
WO 2017037240 A1 3/2017

OTHER PUBLICATIONS

U.S. Non-Final Office Action for U.S. Appl. No. 15/861,783; dated Jun. 25, 2020; 20 Pages.
European Search Report for EP 18248187.9 dated May 27, 2019; 9 pages.
European Search Report for EP 19150380.4 dated Jun. 6, 2019; 9 pages.
CN Office Action; dated Nov. 4, 2020; CN Application No. 201910004360.1; filed Jan. 3, 2019; 9 pages.

* cited by examiner

ELEVATOR INSPECTION USING AUTOMATED SEQUENCING OF CAMERA PRESETS

BACKGROUND

The subject matter disclosed herein generally relates to elevator systems and, more particularly, to elevator inspection using automated sequencing of camera presets.

For inspection of an elevator system, a mechanic physically inspects the top and the bottom of an elevator car to inspect various components of the elevator system. Due to the confined nature of an elevator system, physical inspection of components of an elevator car can be difficult.

BRIEF DESCRIPTION

According to one embodiment, an elevator system is provided. The elevator system includes at least one elevator car and a camera affixed to the at least one elevator car, wherein the camera is operated by a controller. The controller is configured to automatically capture, from the camera, media associated with a set of locations, wherein the set of locations are associated with the at least one elevator car. A transceiver transmits one or more sequences of the media captured from the camera.

In addition to one or more of the features described above, or as an alternative, further embodiments of the elevator system may include that the camera is a first camera and a second camera affixed to the at least one elevator car, wherein the second camera is operated by the controller. The controller is configured to automatically capture, from the second camera, media associated with the set of locations. And a transceiver transmits one or more sequences of the media captured from the second camera.

In addition to one or more of the features described above, or as an alternative, further embodiments of the elevator system may include that the media comprises at least one of an image and a video.

In addition to one or more of the features described above, or as an alternative, further embodiments of the elevator system may include that the media associated with the set of locations is captured at a first time and that the set of locations comprise locations associated with components of the at least one elevator car. The controller is configured to automatically capture, from the camera, second media associated with the set of locations, wherein the second media is captured at a second time. And that the second time is different from the first time. The controller is configured to compare the media to the second media to determine a change to at least one of the components of the at least one elevator car and transmit an alert based at least on the change to the at least one of the components.

In addition to one or more of the features described above, or as an alternative, further embodiments of the elevator system may include that the controller is further configured to receive reference media associated with the set of locations, compare the media to the reference media to determine a change to at least one of the components of the at least one elevator car, and transmit an alert based at least on the change to the at least one of the components.

In addition to one or more of the features described above, or as an alternative, further embodiments of the elevator system may include that the reference media comprises media captured during an inspection of one or more components associated with the set of locations.

In addition to one or more of the features described above, or as an alternative, further embodiments of the elevator system may include that wherein the reference media comprises media of one or more components associated with the set of locations that are operating within normal tolerances.

In addition to one or more of the features described above, or as an alternative, further embodiments of the elevator system may include that the one or more sequences of the media are transmitted periodically.

In addition to one or more of the features described above, or as an alternative, further embodiments of the elevator system may include that the media transmitted periodically is according to an elevator inspection schedule.

In addition to one or more of the features described above, or as an alternative, further embodiments of the elevator system may include that the elevator inspection schedule comprises the set of locations associated with the at least one elevator car.

In addition to one or more of the features described above, or as an alternative, further embodiments of the elevator system may include that the one or more sequences of the media captured from the camera can be based at least in part on a type of inspection.

In addition to one or more of the features described above, or as an alternative, further embodiments of the elevator system may include that the one or more sequences of the media captured from the camera can be based at least in part on a user input.

According to one embodiment, a method is provided. The method includes receiving, by a processor, a request to inspect an elevator car in an elevator system, wherein a camera is affixed to the elevator car. Capturing, from the camera, media associated with a set of locations, wherein the set of locations are associated with the elevator car and transmitting, a sequence of media captured from the camera.

In addition to one or more of the features described above, or as an alternative, further embodiments of the method may include that the camera is a first camera and further comprising capturing, from a second camera, media associated with the set of locations and transmitting a second sequence of media captured from the second camera.

In addition to one or more of the features described above, or as an alternative, further embodiments of the method may include that the media comprises at least one of an image and a video.

In addition to one or more of the features described above, or as an alternative, further embodiments of the method may include that the media associated with the set of locations is captured at a first time, wherein the set of locations comprise locations associated with components of the at least one elevator car. And automatically capturing, from the plurality of cameras, second media associated with the set of locations, wherein the second media is captured at second time, and wherein the second time is different from the first time. The media is compared to the second media to determine a change to at least one of the components of the at least one elevator car and an alert is transmitted based at least on the change to the at least one of the components.

In addition to one or more of the features described above, or as an alternative, further embodiments of the method may include that the one or more sequences of the media are transmitted periodically In addition to one or more of the features described above, or as an alternative, further embodiments of the method may include that the media transmitted periodically is according to an elevator inspection schedule.

According to one embodiment, an escalator system is provided. The escalator system includes a passenger riding area defined by a continuous loop of steps, one or more balustrades, and one or more handrails, a drive system, at least one machine room and a camera affixed to at least one portion of the escalator system, wherein the camera is operated by a controller. The controller is configured to automatically capture, from the camera, media associated with a set of locations, wherein the set of locations are associated with the at least one elevator car. A transceiver transmits one or more sequences of the media captured from the camera.

In addition to one or more of the features described above, or as an alternative, further embodiments of the escalator system may include that the media comprises at least one of an image and a video.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
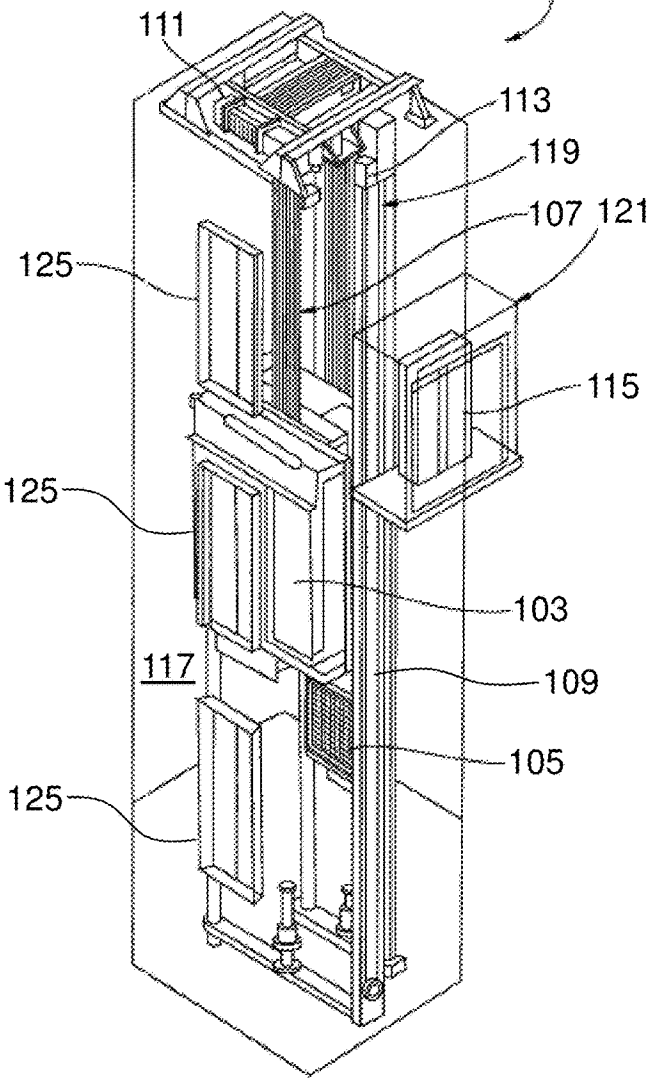
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
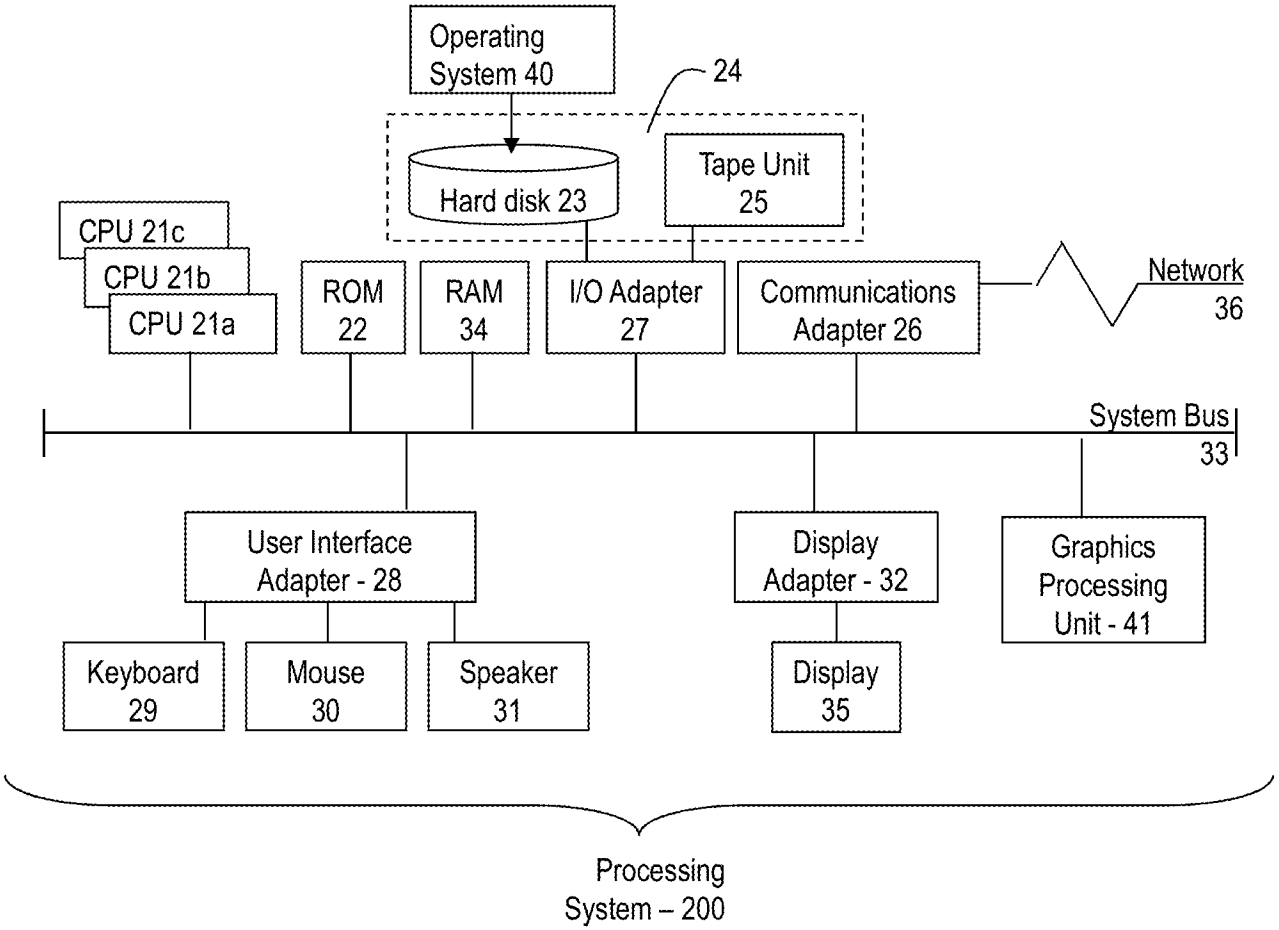
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 200.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network communications adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes.

Turning now to an overview of technologies that are more specifically relevant to aspects of the disclosure, during elevator maintenance and inspection operations, an elevator mechanic must occasionally inspect the top of an elevator car and the bottom of the elevator car. This may require the elevator mechanic to exit the elevator car and enter the elevator hoistway.

Turning now to an overview of the aspects of the disclosure, one or more embodiments address the above-described shortcomings of the prior art by providing cameras for automated elevator inspections. Cameras located on the top and/or the bottom of an elevator car are arranged to capture images and video of components of the elevator car. For example, a camera could focus on a roller and/or counter weight to allow for inspection by an elevator mechanic. The cameras can automatically capture images or video for these components on an elevator car and transmit, via a transceiver, to an elevator mechanic utilizing a user device such as a laptop, mobile phone, and the like. The capture images and videos are transmitted to the user in a specific sequence that allows the user (e.g., mechanic) to inspect the components of the elevator car. Some common inspection points for an elevator include, but are not limited to, cleanliness of the top and bottom of the car, inspection box, rollers, and oil level indicators, water/cleanliness of the pad, the counterweight, governors, and tension devices. For example, some bottom of the car inspection points include rollers, safety links, compensation chains, travelling cable joints, S hooks, belt tracking, guides (rolling/sliding), and the like. Top of the car inspections points include rollers, oil level, guides (e.g., rolling/sliding), top of car cleanliness, top of car box, and any special equipment on top of car that needs regular checks (e.g., more than what is mandated by code or otherwise). Inspection positions for the general hoistway include views of machines in the hoistway, almost entire rope as the elevator moves in the hoistway, hoistway door and door locks, door sills, and the like. The bottom of car and hoistway pit points of interest also include cleanliness, water leaks, buffers, governor tension devices, and the governor sheave, and any equipment in hoistway pit. Each of the cameras are arranged to capture images and video of the different elevator components. Or, in alternate embodiments, the cameras are adjustable to pan, zoom, and focus on multiple components. Images and video can be captured and transmitted in one or more sequences to a user. For example, one type of sequence can be specific to a certain type of inspection. Another type of sequence can be user-specific (e.g., the user defines the sequence of images and video).

Figure 3:
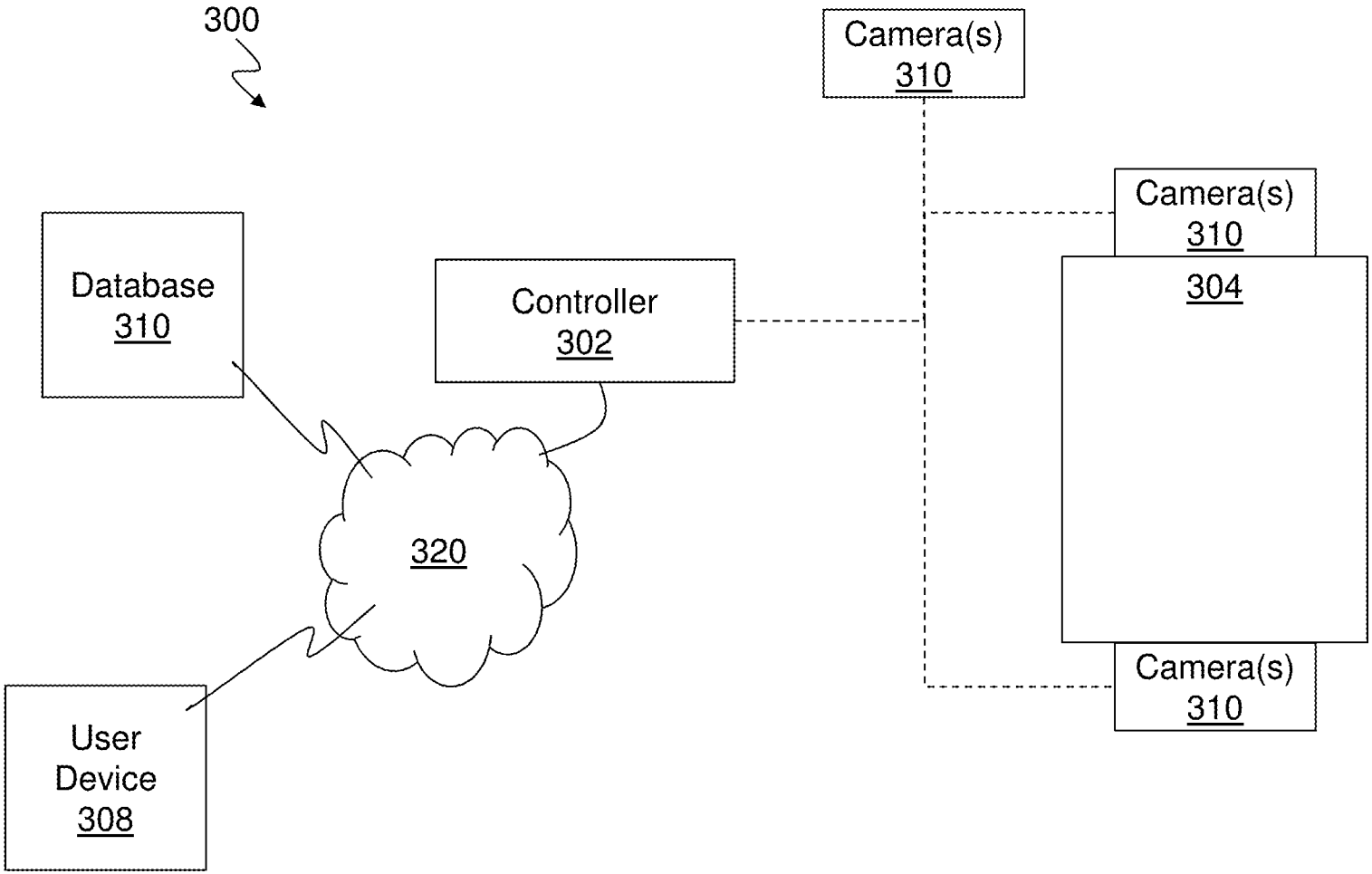
FIG. 3 depicts a block diagram of a system for inspecting an elevator system according to one or more embodiments of the disclosure.

Turning now to a more detailed description of aspects of the present disclosure, FIG. 3 depicts a system 300 for inspecting an elevator system. The system 300 includes an elevator car 304 at least one camera(s) 310 located on or around the elevator car 304. The system 300 also includes a controller 302, a network 320, a database 310, and a user device 308.

In one or more embodiments, the controller 302 can be implemented on the processing system 200 found in FIG. 2. Additionally, a cloud computing system can be in wired or wireless electronic communication with one or all of the elements of the system 300. Cloud computing can supplement, support or replace some or all of the functionality of the elements of the system 300. Additionally, some or all of the functionality of the elements of system 300 can be implemented as a node of a cloud computing system. A cloud computing node is only one example of a suitable cloud computing node and is not intended to suggest any limitation as to the scope of use or functionality of embodiments described herein.

In one or more embodiments, the controller 302 is operable to control the cameras 310 and capture images and video from each of the cameras 310 to store in a database 310 or transmit directly to a user device 308 via the network 320. In one embodiment, the cameras 310 may be controlled and images and video captured through the cloud server 320, user device 308, or some other remotely located device. The user device 308 can include a device carried by a user, such as a smart phone, PDA, tablet, laptop, etc. The cameras 310 can be mounted in an elevator system at locations such as, for example, the top of a hoistway, the bottom of a hoistway, the top of an elevator car 304, the bottom of the elevator car 304, a machine room, or any other location in the elevator system, including within the elevator car 304.

In one or more embodiments, the cameras 310 can be any type of camera that can be used to generate video and/or still frame images. The cameras 310 can capture any type of video images such as, for example, infrared images, depth, image, and the like. The cameras 310 can be wired or wireless cameras that can connect to the controller 302 through a wired or wireless network connection. The cameras 310 mentioned herein are only examples of suitable camera types and are not intended to suggest any limitation as to the scope of use or functionality of the cameras.

In one or more embodiments, the controller 302, cloud server, 320, user device 308, and/or any other desired node can capture a series of images and videos (i.e., media) for a set of locations corresponding to components and areas of interest on or around the elevator car 304. The controller 302 captures the media and transmits the media arranged in one or more sequences for review by a mechanic for inspection of the elevator car 304. The sequences can be pre-set sequences. For example, the media can be transmitted and displayed on a user 308 device and cycled every 10 seconds for review by the user. The set of locations are pre-set in the sequence to allow for review by the mechanic. The media capture by the cameras 310 can be done periodically or can be upon a user request. Capturing the media periodically can be done according with prescribed maintenance and/or elevator inspection code requirements. Code requires an inspection every 6 months which can trigger the capturing of media related to certain required inspection components every 6 months. In addition, elevator codes may require an inspection every year related to certain components which could trigger the capturing of media related to those components on a yearly basis. In one embodiment, capturing the media periodically can be done in accordance with any desired code interval. In one or more embodiments, in addition to the pre-set locations, a user can request specific locations for the cameras to focus on based on input to the user device 308. For example, a user may request another angle of a roller on the elevator car 304. The controller 302 could automatically adjust a camera 310 near the requested roller to obtain the proper angle or view. Or the user could adjust the camera 310 by inputting commands into the user device 308. In one or more embodiments, the cameras are operable to pan, zoom, adjust angles, and otherwise maneuver to view multiple locations on the elevator car 304.

In one or more embodiments, the controller 302, cloud server 320, user device 308, or some other remotely located device can automatically notify a user via the user device 308 of a scheduled inspection of the elevator car 304. The controller 302 can transmit a sequence of images or videos of a set of locations on or around the elevator car 304 and as the user is viewing each image or video, the user can input a confirmation of the inspection as the sequence is cycling. For example, a sequence of pre-set images may be presented to the mechanic and as each image is reviewed by the user, the user can input into the user device 308 an indication that the pre-set image passes the inspection, fails the inspection, or requires a follow up. The user can also save one or more of the images or videos for further review by the user or have the images or videos be sent to another user such as a manager or another mechanic for review. The sequences of images and videos are stored in the database 310 and can be accessed by multiple user devices 308 via the network 320.

In one or more embodiments, the controller 302 cloud server 320, user device 308, or some other remotely located device can store images of components for the elevator car 304 that have been accepted by the mechanic as being in good operating condition. These images can be utilized as reference images for one or all of the components of the elevator car 304. The reference images can be stored in the database 310 for access at another time. For example, the reference images may be obtained while a mechanic is on site working on the elevator car 304 and has deemed that all components of the car 304 are operating within normal tolerances. The controller 302 can capture new images of the set of locations from the cameras 310 at a later time and compare these new images to the reference images for the corresponding locations. These new images can be captured at a specific time, periodically, or as requested by a mechanic. The controller 302 can compare the new images to the reference images using image analyzation techniques, to determine any changes between the reference images and the new images. A comparison score can be obtained based on the changes between the images. This may be performed by comparing pixel values at the same locations in the new image and the reference image, or by any other known image comparison tool. A difference in pixel value at one location in the new image and the reference image indicates a change between the new image and the reference image. The absolute values of all the pixel differences between new image and the reference image may then be summed to generate a comparison score. The pixel comparisons may be made, for example, based on change in color, change in brightness, etc.

In one or more embodiments, if the comparison score exceeds a threshold value, the controller 302 can generate an alert and send the alert to the user device 308. The threshold value can be adjusted by the user. Multiple threshold values can be set to determine the type of alert sent to the user. For example, exceeding a larger threshold value may generate an alert sent more frequently or sent to multiple user devices 308 to amplify the severity of the change to the component image.

Figure 4:
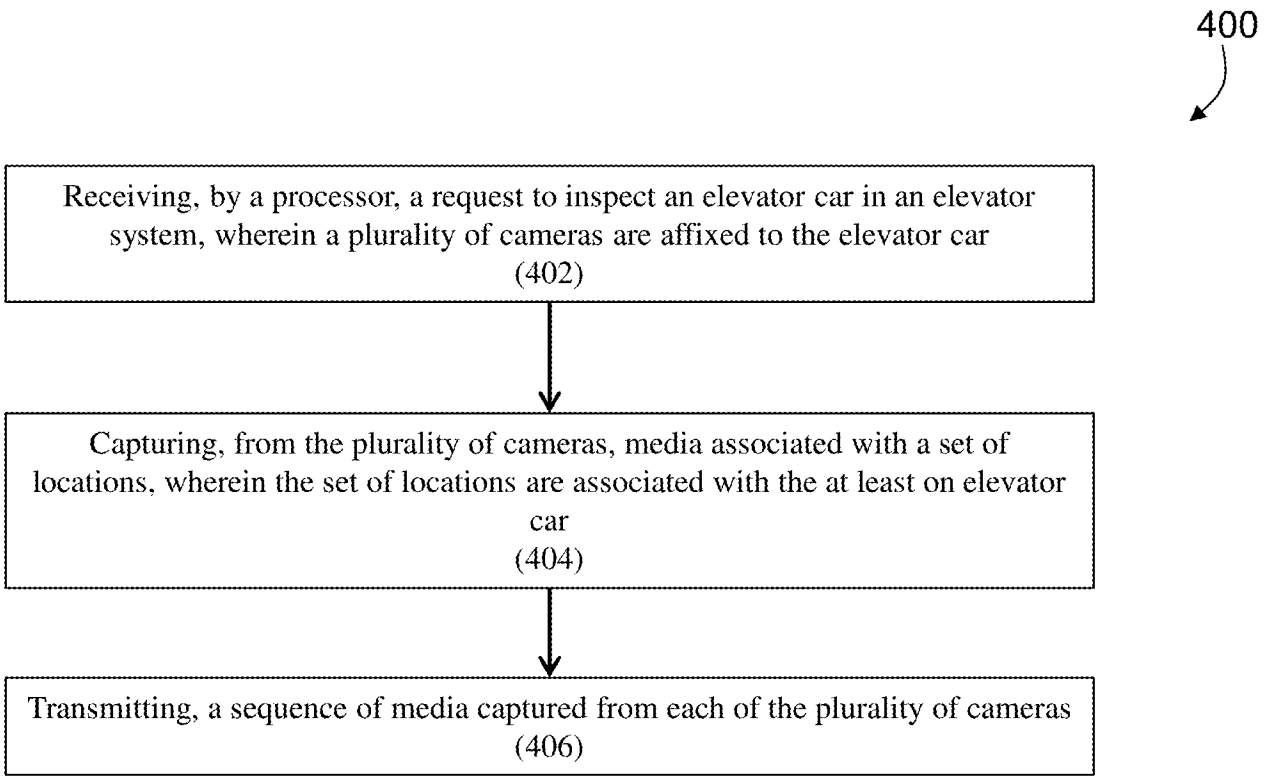
FIG. 4 depicts a flow diagram of a method for inspecting an elevator system according to one or more embodiments of the disclosure.

FIG. 4 depicts a flow diagram of a method for inspecting an elevator system according to one or more embodiments. The method 400 includes receiving, by a processor, a request to inspect an elevator car in an elevator system, wherein a plurality of cameras are affixed to the elevator car, as shown at block 402. At block 404, the method 400 includes capturing, from the plurality of cameras, media associated with a set of locations, wherein the set of locations are associated with the at least on elevator car. The method 400, at block 406, includes transmitting, a sequence of media captured from each of the plurality of cameras to controller 302 for processing as described herein.

Additional processes may also be included. It should be understood that the processes depicted in FIG. 4 represent illustrations and that other processes may be added or existing processes may be removed, modified, or rearranged without departing from the scope and spirit of the present disclosure.

Figure 5:
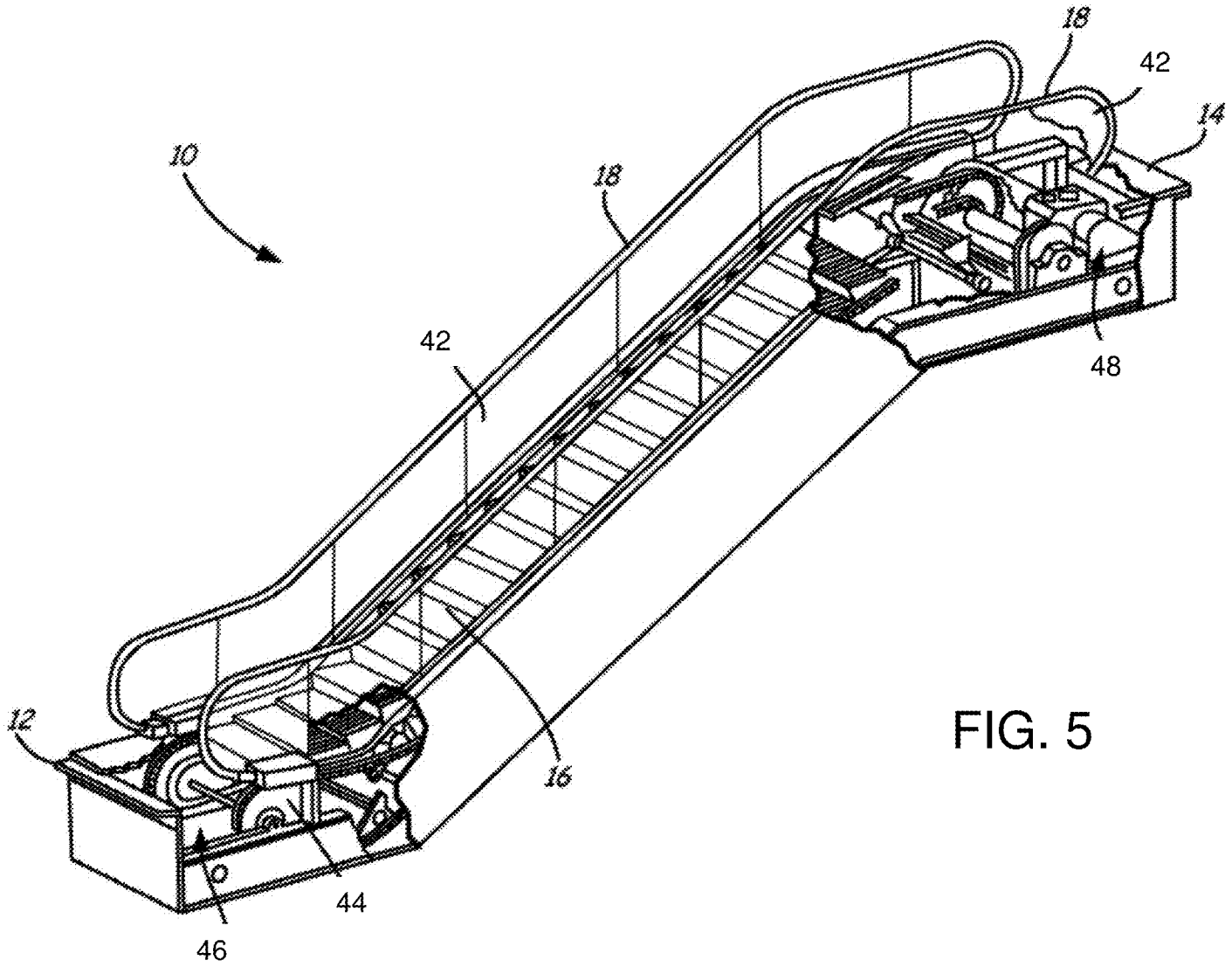
FIG. 5 is a perspective view of escalator according to one or more embodiments of the disclosure.

FIG. 5 is a perspective view of escalator 10, which includes first landing 12, second landing 14, a continuous loop of steps 16, handrails 18, balustrades 42 defining a passenger riding area therebetween, drive system 44, and machine rooms 46, 48. Steps 16 extend from first landing 12 to second landing 14. Balustrades 22 extend along the side of steps 16 from first landing 12 to second landing 14, and handrails 18 are slidingly engaged with each balustrade 22. Drive system 44 is configured to drive steps 16 and handrails 18 at a constant speed and in synchrony with one another. A first portion of drive system 24 is located in machine room 46 and a second portion of drive system 44 is located in machine room 48. FIG. 5 is merely a non-limiting example presented for illustrative and explanatory purposes.

In one or more embodiments, one or more cameras can be affixed to locations on the escalator 10 to capture media related to inspection of the escalator. For example, a camera can be affixed to the drive system 44 and machine rooms 46, 48 to capture media related to components of the escalator system 10. In one or more embodiments, a controller is operable to control the cameras and capture images and video from each of the cameras to store in a database or transmit directly to a user device via the network. In one embodiment, the cameras may be controlled and images and video captured through a cloud server, user device, or some other remotely located device. The controller, cloud server, user device, and/or any other desired node can capture a series of images and videos (i.e., media) for a set of locations corresponding to components and areas of interest on or around the escalator 10. The controller captures the media and transmits the media arranged in one or more sequences for review by a mechanic for inspection of the escalator 10. The sequences can be pre-set sequences. For example, the media can be transmitted and displayed on a user device and cycled every 10 seconds for review by the user. The set of locations are pre-set in the sequence to allow for review by the mechanic. The media capture by the cameras can be done periodically or can be upon a user request. Capturing the media periodically can be done according with prescribed maintenance and/or escalator inspection code requirements. In one or more embodiments, in addition to the pre-set locations, a user can request specific locations for the cameras to focus on based on input to the user device.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:

at least one elevator car;

a camera affixed to the at least one elevator car, wherein the camera is operated by a controller; and wherein the controller is configured to:

automatically capture, from the camera, media associated with a set of locations, wherein the set of locations are associated with the at least one elevator car; and transmit, by a transceiver, one or more sequences of the media captured from the camera;

wherein the media associated with the set of locations is captured at a first time;

wherein the set of locations comprise locations associated with components of the at least one elevator car;

wherein the controller is further configured to:

automatically capture, from the camera, second media associated with the set of locations, wherein the second media is captured at a second time, wherein the second time is different from the first time;

compare the media to the second media to determine a change to at least one of the components of the at least one elevator car; and transmit an alert based at least on the change to the at least one of the components.

2. The elevator system of claim 1, wherein the camera is a first camera; and further comprising:

a second camera affixed to the at least one elevator car, wherein the second camera is operated by the controller; and wherein the controller is configured to:

automatically capture, from the second camera, media associated with the set of locations; and transmit, by a transceiver, one or more sequences of the media captured from the second camera.

3. The elevator system of claim 1, wherein the media comprises at least one of an image and a video.

4. The elevator system of claim 1, wherein the controller is further configured to:

receive reference media associated with the set of locations;

compare the media to the reference media to determine a change to at least one of the components of the at least one elevator car; and transmit an alert based at least on the change to the at least one of the components.

5. The elevator system of claim 4, wherein the reference media comprises media captured during an inspection of one or more components associated with the set of locations.

6. The elevator system of claim 4, wherein the reference media comprises media of one or more components associated with the set of locations that are operating within normal tolerances.

7. The elevator system of claim 1, wherein the one or more sequences of the media are transmitted periodically.

8. The elevator system of claim 7, wherein the media transmitted periodically is according to an elevator inspection schedule.

9. The elevator system of claim 8, wherein the elevator inspection schedule comprises the set of locations associated with the at least one elevator car.

10. The elevator system of claim 1, wherein the one or more sequences of the media captured from the camera can be based at least in part on a type of inspection.

11. The elevator system of claim 1, wherein the one or more sequences of the media captured from the camera can be based at least in part on a user input.

12. A method for inspecting an elevator system, the method comprising:

receiving, by a processor, a request to inspect an elevator car in an elevator system, wherein a camera is affixed to the elevator car;

capturing, from the camera, media associated with a set of locations, wherein the set of locations are associated with the elevator car; and transmitting, a sequence of media captured from the camera;

wherein the media associated with the set of locations is captured at a first time;

wherein the set of locations comprise locations associated with components of the at least one elevator car; and further comprising:

automatically capturing, from the plurality of cameras, second media associated with the set of locations, wherein the second media is captured at second time, wherein the second time is different from the first time;

comparing the media to the second media to determine a change to at least one of the components of the at least one elevator car; and transmitting an alert based at least on the change to the at least one of the components.

13. The method of claim 12, wherein the camera is a first camera; and further comprising:

capturing, from a second camera, media associated with the set of locations; and transmitting a second sequence of media captured from the second camera.

14. The method of claim 12, wherein the media comprises at least one of an image and a video.

15. The method of claim 12, wherein the one or more sequences of the media are transmitted periodically.

16. The method of claim 15, wherein the media transmitted periodically is according to an elevator inspection schedule.

17. An escalator system comprising:

a passenger riding area defined by a continuous loop of steps, one or more balustrades, and one or more handrails;

a drive system;

at least one machine room;

a camera affixed to at least one portion of the escalator system, wherein the camera is operated by a controller; and wherein the controller is configured to:

automatically capture, from the camera, media associated with a set of locations, wherein the set of locations are associated with the escalator system; and transmit, by a transceiver, one or more sequences of the media captured from the camera;

wherein the media associated with the set of locations is captured at a first time;

wherein the set of locations comprise locations associated with components of the at least one elevator car;

wherein the controller is further configured to:

automatically capture, from the camera, second media associated with the set of locations, wherein the second media is captured at a second time, wherein the second time is different from the first time;

compare the media to the second media to determine a change to at least one of the components of the at least one elevator car; and transmit an alert based at least on the change to the at least one of the components.

18. The escalator system of claim 17, wherein the media comprises at least one of an image and a video.

* * * * *